US008210247B2

(12) United States Patent
Blomgren

(10) Patent No.: US 8,210,247 B2
(45) Date of Patent: Jul. 3, 2012

(54) PLATE HEAT EXCHANGER

(75) Inventor: Ralf Erik Blomgren, Skanor (SE)

(73) Assignee: Alfa Laval Corporate AB (SE)

( * ) Notice: Subject to any disclaimer, the term of this patent is extended or adjusted under 35 U.S.C. 154(b) by 773 days.

(21) Appl. No.: 12/281,822

(22) PCT Filed: Mar. 28, 2007

(86) PCT No.: PCT/SE2007/050195

§ 371 (c)(1),
(2), (4) Date: Sep. 24, 2008

(87) PCT Pub. No.: WO2007/114777

PCT Pub. Date: Oct. 11, 2007

(65) Prior Publication Data

US 2009/0090496 A1 Apr. 9, 2009

(30) Foreign Application Priority Data

Apr. 6, 2006 (SE) ..... 0600784

(51) Int. Cl.
*F28D 9/00* (2006.01)

(52) U.S. Cl. ..... 165/157; 165/167

(58) Field of Classification Search ..... 165/157, 165/166, 167, 916

See application file for complete search history.

(56) References Cited

U.S. PATENT DOCUMENTS

| | | | | |
|---|---|---|---|---|
| 2,217,316 A | | 10/1940 | Kallstenius | |
| 2,236,976 A | * | 4/1941 | Rosenblad | 29/890.03 |
| 2,251,066 A | | 7/1941 | Persson et al. | |
| 3,223,155 A | * | 12/1965 | Hubbard | 165/176 |
| 3,743,011 A | * | 7/1973 | Frost | 165/283 |
| 3,762,467 A | * | 10/1973 | Poon et al. | 165/163 |
| 6,170,568 B1 | * | 1/2001 | Valenzuela | 165/167 |
| 6,497,274 B2 | * | 12/2002 | Cheadle | 165/167 |
| 2005/0039896 A1 | | 2/2005 | Laine et al. | |

FOREIGN PATENT DOCUMENTS

| | | |
|---|---|---|
| AU | 14106/95 | 8/1995 |
| GB | 2132330 | 7/1984 |
| GB | 2132330 A | 7/1984 |
| JP | 2005037028 | 2/2005 |
| SU | 1038789 A1 | 8/1983 |
| WO | 95/19536 | 7/1995 |
| WO | 2004/090450 | 10/2004 |
| WO | WO2004090450 A1 | 10/2004 |

OTHER PUBLICATIONS

English Translation of Decision on Grant of Russian Application 2008143985/06 (057377) filed Mar. 28, 2007 in a counter-part Russian Patent Application.
Form PCT/IB/373.
Form PCT/ISA/237.

* cited by examiner

*Primary Examiner* — Allen Flanigan
(74) *Attorney, Agent, or Firm* — Fish & Richardson P.C.

(57) ABSTRACT

The invention relates to a plate heat exchanger with a plate packet including a plurality of heat exchanger plates, which are stacked onto each other. The heat exchanger plates form first plate interspaces for a first medium and second plate interspaces for a second medium. The plate package has a space which is disposed inside a first inlet and a first outlet. Structure is arranged for creating, for each of the first plate interspaces, an inlet opening for the first medium from the space into the first plate interspaces and an outlet opening for the first medium from the first plate interspaces to the space.

31 Claims, 6 Drawing Sheets

PLATE HEAT EXCHANGER

THE BACKGROUND OF THE INVENTION AND PRIOR ART

The invention refers to a plate heat exchanger according to the preamble of claim 1, see JP 2005-37028.

JP 2005-37028 discloses a plate heat exchanger comprising a plate package with a plurality of heat exchanger plates, which are stacked onto each other and arranged in such a way that they, in the plate package form first plate interspaces for a first medium and second plate interspaces for a second medium. A casing encloses the plate package and comprises a circular cylindrical outer envelope and two end members. A first inlet and a first outlet are adapted to convey the first medium into and out from the plate heat exchanger and extend through a respective one of the two end members. A second inlet and a second outlet are adapted to convey the second medium into and out from the plate heat exchanger. Each of the heat exchanger plates comprises an opening forming a space in the plate package. The space is located inside the first inlet and the first outlet, and is divided in two axially after each other disposed part spaces by means of a partition sheet extending through the plate package in parallel with the heat exchanger plates. Due to the partition sheet, the access to the first plate interspaces is difficult, especially if all heat exchanger plates are welded or brazed to each other. By means of this known design a flow of the first medium from the space radially outwardly in the plate package and from a radially outer position radially inwardly back to the space is obtained. With such flow paths it is difficult to achieve a heat exchanger where the media are flowing in counter flow.

WO2004/090450 discloses a plate heat exchanger comprising a plate package and a plurality of heat exchanger plates which are stacked onto each other. Each heat exchanger plate has a number of eccentric openings. A casing encloses the plate package and comprises a circular cylindrical outer envelope and two end plate members. A first inlet and a first outlet are adapted to convey the first medium into and out from the plate heat exchanger. A second inlet and a second outlet are adapted to convey the second medium into and out from the plate heat exchanger. According to an embodiment, both the inlets and both the outlets extend through one and the same end plate member. According to another embodiment, both the inlets extend through one of the end plate members and both the outlets through the other end plate member.

U.S. Pat. No. 3,743,011 discloses another plate heat exchanger in the form of an oil cooler for a combustion engine. The plate heat exchanger comprises a plate package with a plurality of heat exchanger plates, which are stacked onto each other and which each comprises a central opening. A casing encloses the plate package and comprises an outer envelope with a non-circular cross section and two end plates. A first inlet and a first outlet are adapted to convey the first medium into and out from the plate heat exchanger. A second inlet and a second outlet are adapted to convey the second medium into and out from the plate heat exchanger. The first inlet and the first outlet extend through a respective one of the two end plates. The second inlet and the second outlet extend through a common plane portion of the outer envelope.

SUMMARY OF THE INVENTION

The object of the present invention is to provide an improved plate heat exchanger of the kind initially defined. A further object is to provide a plate heat exchanger which can be manufactured with relatively large dimensions. A further object is to provide a plate heat exchanger which has such a design that it permits an easy inspection and cleaning.

This object is achieved by the plate heat exchanger initially defined, which is characterized in that it comprises means arranged to create, for each of the first plate interspaces, an inlet opening for the first medium from the space into the first plate interspace and an outlet opening for the first medium from the first plate interspace to the space.

By means of such inlet openings and outlet openings, which are separated from each other, the first medium will be conveyed into and out from the plate package along the whole length of the space. It is thus possible to create a favorable flow path for the first medium through all the first plate interspaces in the plate package. Thanks to the circular-cylindrical outer envelope, it is also possible to provide a strong plate heat exchanger which resists high pressures and various pressures of the different, preferably two media. A circular cylindrical outer envelope permits a thinner thickness of material than an envelope with a polygonal shape.

According to an embodiment of the invention, the first inlet opening and the first outlet opening are disposed in such a way that the first medium is divided into two flow paths in the first plate interspace between the inlet opening and the outlet opening. Advantageously, the inlet opening and the outlet opening are located opposite to each other on a respective side of the centre axis. In such a way, the flow of the first medium will be divided into two part flows which both extend from the inlet openings to the outlet openings along a respective semi-circular, or substantially semi-circular, flow path. A plate heat exchanger may be designed in such a way that the first medium may be conveyed either in parallel flow or in counter flow with respect to the second medium.

According to a further embodiment of the invention, the first inlet has a cross sectional area perpendicular to the centre axis, the first outlet has a cross sectional area perpendicular to the centre axis and the space has a cross sectional area perpendicular to the centre axis. The sum of the cross sectional area of the first inlet and the cross sectional area of the first outlet is equal to or approximately equal to the cross sectional area of the space. Such a dimensioning of the cross sectional area of the space is favorable since it creates space for cleaning, maintenance and different components for guiding the flow of the first medium into and out from the first plate interspaces.

According to a further embodiment of the invention, the plate heat exchanger comprises a separation device disposed in the space and arranged to divide the space into a first part space and a second part space, which part spaces extend through the opening of all heat exchanger plates. Such a separation device permits a dividing of the space for the inflow of the first medium and the outflow of the first medium. Advantageously, the separation device may be displaceably or loosely provided in the space and maintained in a position in the space by means of the end plate members.

According to a further embodiment of the invention, the first part space forms a first inlet chamber, which extends through the opening of all heat exchanger plates and permits communication between the first inlet and the inlet openings, and the second part space forms a first outlet chamber, which extends through the opening of all heat exchanger plates and permits communication between the first outlet and the outlet openings.

According to a further embodiment of the invention, at least one of the first part space and the second part space is divided into at least two sections, wherein one of the sections forms an inlet chamber for the first medium, and the second of the sections forms an outlet chamber for the first medium. It is then possible to let the second part space form either an inlet chamber or an outlet chamber for the first medium. It is also possible to let the second part space be divided into at least two sections, wherein one of the sections forms an outlet chamber for the first medium and the other of the sections forms an inlet chamber for the first medium.

According to a further embodiment of the invention, the separation device comprises a partition sheet which extends through the opening of all heat exchanger plates and which forms a wall between the first part space and the second part space. Such a partition sheet may be provided in an easy manner. It may be substantially plane, curved or exhibit sections with a different angle in relation to the centre axis.

According to a further embodiment of the invention, said means comprises an inner envelope which is provided in the space and forms a wall between the space and the first plate interspaces, wherein the inner envelope comprises two slots forming said inlet openings and said outlet openings. According to this embodiment, the inlet and outlet openings are provided in an easy manner. No particular measures need to be taken in the plate package proper in order to limit the lateral size of the inlet and outlet openings.

According to a further embodiment of the invention, the separation device is provided in and connected to the inner envelope. In such a way, the separation device and the inner envelope form an insert unit which is located in the space. This insert unit may be removable from the space in order to create accessibility to the first plate interspaces.

According to a further embodiment of the invention, the space is concentric with respect to the centre axis. The slots may then advantageously be located opposite to each other on a respective side of the centre axis.

According to a further embodiment of the invention, each of the heat exchanger plates has an outer edge and a circular shape along more than half of the outer edge. By letting the heat exchanger plates have such a substantially circular shape, the strength is further improved. A circular shape of the heat exchanger plates gives a more uniform movement of the material due to thermal expansion. Advantageously, the outer edge of the heat exchanger plates, where it has said circular shape, may then abut substantially or be located at a small distance from an inner surface of the outer envelope.

According to a further embodiment of the invention, each heat exchanger plate has a recess, disposed immediately inside the second inlet, and a recess, disposed immediately inside the second outlet, wherein the recess inside the second inlet creates space for a second inlet chamber, which communicates with the second inlet and the second plate interspaces, and wherein the recess inside the second outlet creates space for a second outlet chamber, which communicates with the second outlet and the second plate interspaces. Such inlet and outlet chambers for the second medium, which permit a proper distribution of the second medium, may be provided in an easy manner by means of a respective recess or cut in each heat exchanger plate.

According to a further embodiment of the invention, the second inlet and the second outlet extend through the outer envelope. Furthermore, the second inlet and the second outlet may be concentric to each other and advantageously extend along a diametric axis which intersects the centre axis. In such a way, a favorable flow of the second medium through the plate package is achieved. The flow will be divided into two part flows which both extend from the second inlet to the second outlet along a respective semi-circular, or substantially semi-circular, flow path.

According to a further embodiment of the invention, the first inlet and the first outlet are concentric to each other and to the outer envelope. In such a way, a symmetric design is achieved. Such a central location of the first inlet and the first outlet enables a free expansion of the plate package, which is favorable during thermal cycling.

According to a further embodiment of the invention, at least one of the end plate members is attached to the outer envelope by means of a releasable connection. By means of such a plate heat exchanger, cleaning of all the first plate interspaces may be achieved via the space which is disposed inside the first inlet and the first outlet. The construction also creates possibilities to clean all the first plate interspaces through merely one of the first inlet and the second inlet since the space is available via one of these.

According to a further embodiment of the invention, the separation device is displaceable along the centre axis in the space in such a way that the separation device may be pulled out of the space when said at least one end plate member is removed. Furthermore, the inner envelope may be displaceable along the centre axis in the space in such a way that the inner envelope may be pulled out of the space when said at least one end plate member is removed.

According to a further embodiment of the invention, at least one of the end plate members comprises a first plate, which has a first diameter and which is connected to the outer envelope, and a second plate, which has a second diameter that is less than the first diameter and which is attached to the first plate by means of a releasable connection in such a way that the second plate is removable from the first plate. The second plate may be provided on the first plate outside the space.

According to a further embodiment of the invention, the separation device is displaceable along the centre axis in the space in such a way that the separation device can be pulled out from the space when the second plate is removed. The inner envelope is displaceable along the centre axis in the space in such a way that the inner envelope may be pulled out from the space when the second plate is removed.

According to a further embodiment of the invention, the heat exchanger plates in the plate package are welded to each other in pairs. Furthermore, all heat exchanger plates in the plate package may be welded to each other. It is also possible to let at least one of the end plate members, or both the end plate members, be welded to the plate package.

According to a further embodiment of the invention, the end plate members has an inner surface facing the plate package, an outer surface facing away from the plate package and a surrounding surface connecting the first surface and the second surface to each other. Advantageously, the surrounding surface of a first end plate member of the end plate members faces an inner surface of the outer envelope. Each of the inner surface and the outer surface of the first end plate member may then have an area which is somewhat less than an inner cross sectional area of the outer envelope.

According to a further embodiment of the invention, the outer envelope has a first envelope end, a second envelope end, a first flange at the first envelope end and a second flange at the second envelope end, wherein the end plate members are connected to a respective one of the first flange and the second flange. Advantageously, the first flange may extend inwardly from the first envelope end and abut the outer surface of the first end plate member. Furthermore, the second flange may extend outwardly from the second envelope end and abut the inner surface of a second end plate member of the end plate members. In such a way, the outer envelope may be removed from the plate package and the two end plate members.

The object defined above is also achieved by the plate heat exchanger initially defined, which is characterized in that the end plate members have an inner surface facing the plate package, an outer surface facing away from the plate package and a surrounding surface connecting the first surface and the second surface to each other, that the end plate members are attached to the outer envelope by means of a releasable connection and that the surrounding surface of a first end plate member of the end plate members faces an inner surface of the outer envelope. Such a plate heat exchanger may be dismounted and mounted in an easy manner. Consequently, maintenance and cleaning of the plate heat exchanger may be made when the outer envelope in an easy way has been removed from the plate package and the end plate members. The construction also creates possibilities to clean the plate interspaces in an easy manner.

According to an embodiment of the invention, the outer envelope has a first envelope end, a second envelope end, a first flange at the first envelope end and a second flange at the second envelope end, wherein the first end plate member is connected to the first flange and wherein a second end plate member of the end plate members is connected to the second flange. Advantageously, the releasable connection may comprise a screw joint which connects the first end plate member to the first flange and a second screw joint which connects the second end plate member to the second flange. The first flange may extend inwardly from the first envelope end and abut the outer surface of the first end plate member, wherein the first screw joints may extend through the first flange into the first end plate member. The second flange may extend outwardly from the second envelope end and abut the inner surface of the second end plate member, wherein the second screw joints may extend through the second end plate member into the second flange.

BRIEF DESCRIPTION OF THE DRAWINGS

The invention is now to be explained more closely by means of various embodiments, which are described as examples, and with reference to the drawings attached hereto.

DETAILED DESCRIPTION OF VARIOUS EMBODIMENTS

Figure 1:
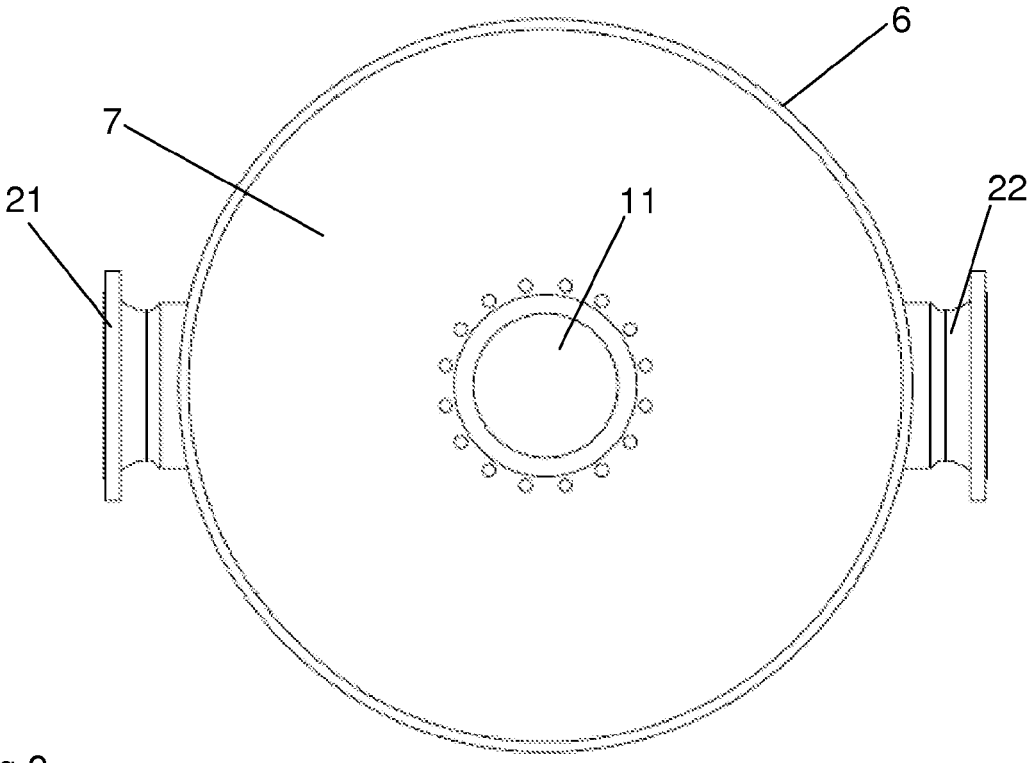
FIG. 1 discloses an elevation view of a plate heat exchanger according to a first embodiment.
Figure 2:
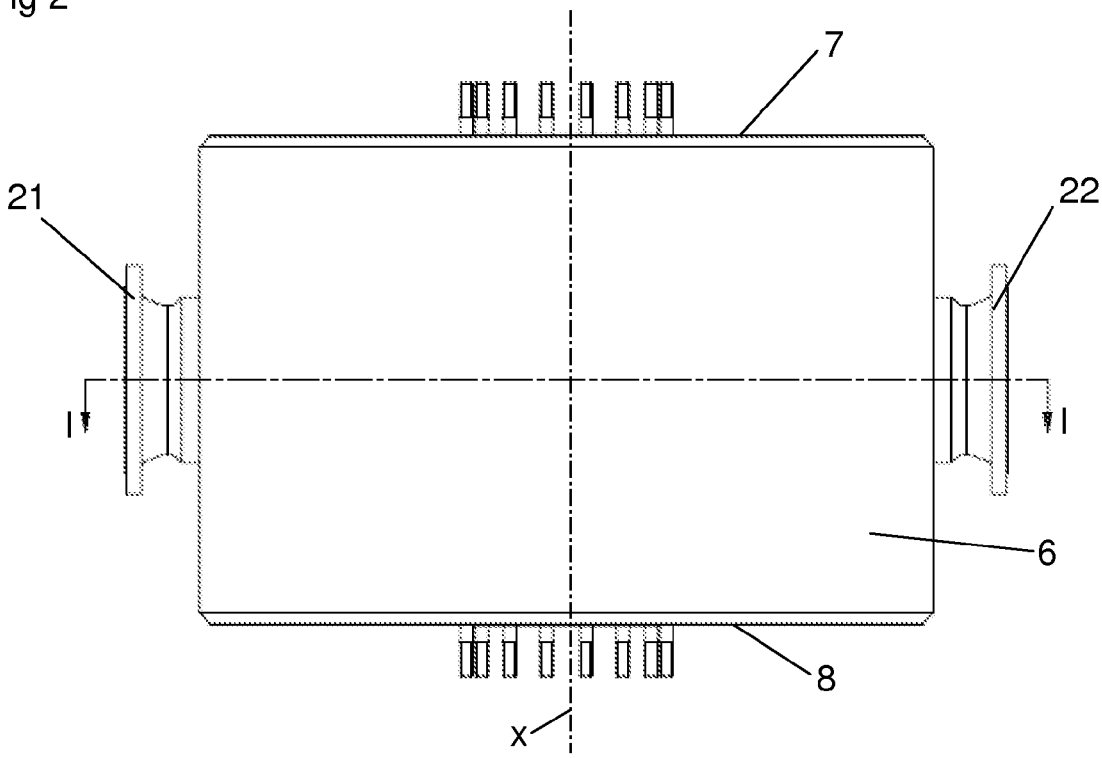
FIG. 2 discloses a side view of the plate heat exchanger in FIG. 1.
Figure 3:
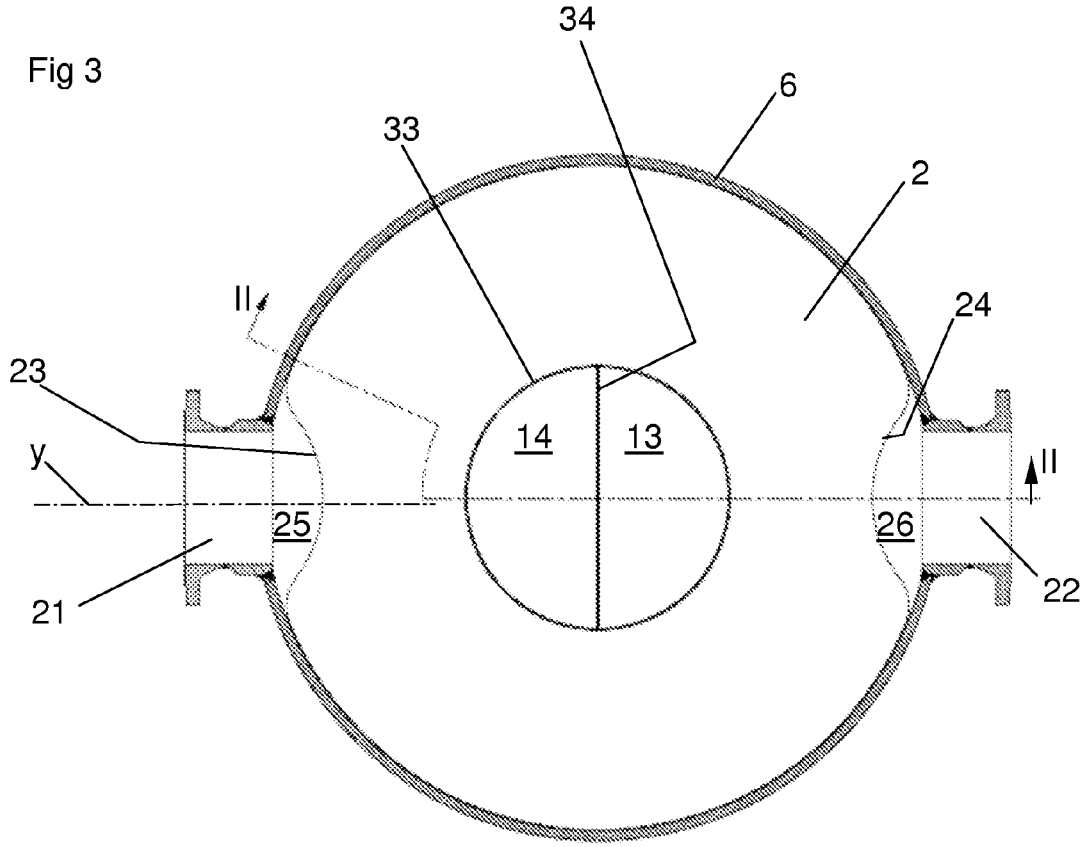
FIG. 3 discloses a cross section through the plate heat exchanger along the line I-I in FIG. 2.
Figure 4:
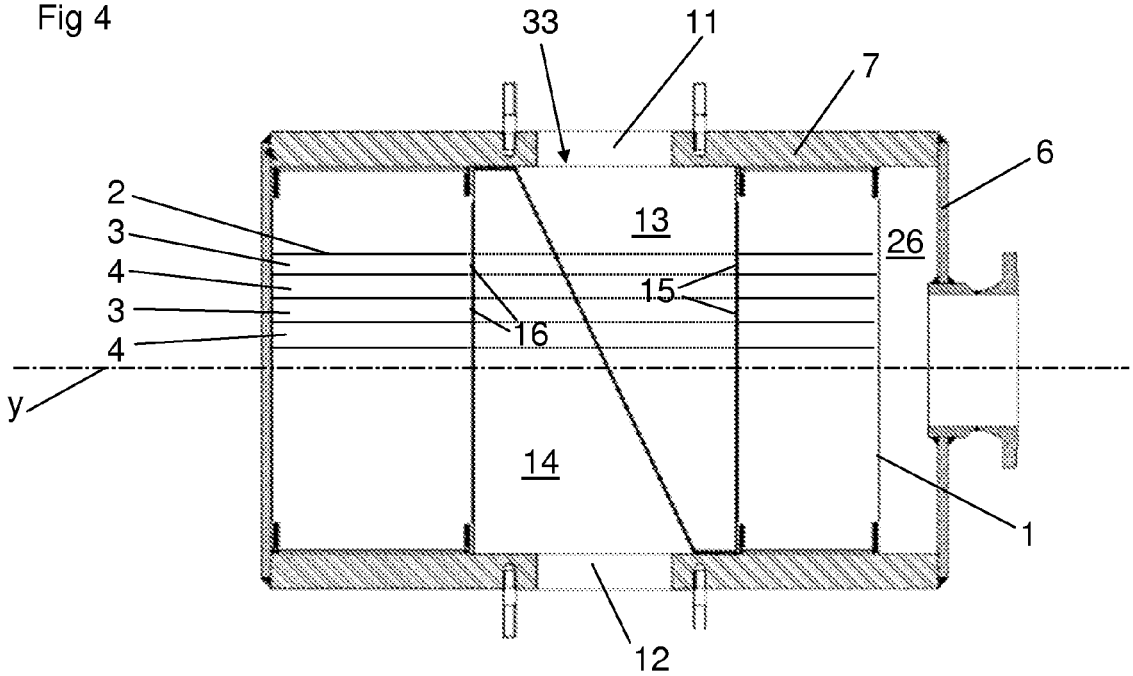
FIG. 4 discloses a longitudinal section through the plate heat exchanger along the line II-II in FIG. 3.

FIGS. 1-7 refers to a first embodiment of the plate heat exchanger in a mounted state. The plate heat exchanger comprises a plate package, which comprises or consists of a plurality of heat exchanger plates 2, see FIGS. 4 and 5. The heat exchanger plates 2 are stacked onto or provided beside each other so that the plate package 1 is formed. The heat exchanger plates 2 may be permanently joined to each other through for instance brazing or welding. It is also possible to connect the heat exchanger plates 2 in pairs in such a way that two heat exchanger plates 2 are permanently joined to each other through for instance brazing or welding. Such pairs of heat exchanger plates 2 may then be provided beside each other in the plate package. In this case, gaskets may be provided between adjacent pairs of heat exchanger plates 2. It is also possible to provide gaskets between all adjacent heat exchanger plates 2.

Independent of how the heat exchanger plates 2 thus are connected to or provided beside each other, they are arranged in such a way that they in the plate package 1 form first plate interspaces 3 for a first medium and second plate interspaces 4 for a second medium. The heat exchanger plates 2 and the plate interspaces 3, 4 are schematically disclosed in FIG. 4. The first plate interspaces 3 and the second plate interspaces 4 are provided in an alternating order so that substantially each first plate interspace 3 adjoins two second plate interspaces 4.

The plate heat exchanger also comprises a casing enclosing the plate package 1. The casing comprises a circular cylindrical outer envelope 6 and two end plate members 7 and 8. The outer envelope 6 defines a longitudinal centre axis x extending through the two end plate members 7 and 8. One or both of the end plate members 7, 8 may be permanently joined to the plate package 1, for instance through brazing or welding.

The plate heat exchanger comprises a first inlet 11 and a first outlet 12, which are adapted to convey the first medium into and out from the plate heat exchanger. Furthermore, the plate heat exchanger comprises a second inlet 21 and a second outlet 22, which are adapted to convey the second medium into and out from the plate heat exchanger. The first inlet 11 and the first outlet 12 extend through a respective one of the two end plate members 7 and 8, respectively, and are in the embodiment disclosed concentric, or substantially concentric, to each other. More precisely, the first inlet 11 and the first outlet 12 are concentric, or substantially concentric, to the outer envelope 6. The second inlet 21 and the second outlet 22 extend through the outer envelope 6. The second inlet 21 and the second outlet 22 are concentric, or substantially concentric, to each other and more precisely extend along a diametric axis y intersecting the centre axis x with a right angle.

Figure 5:
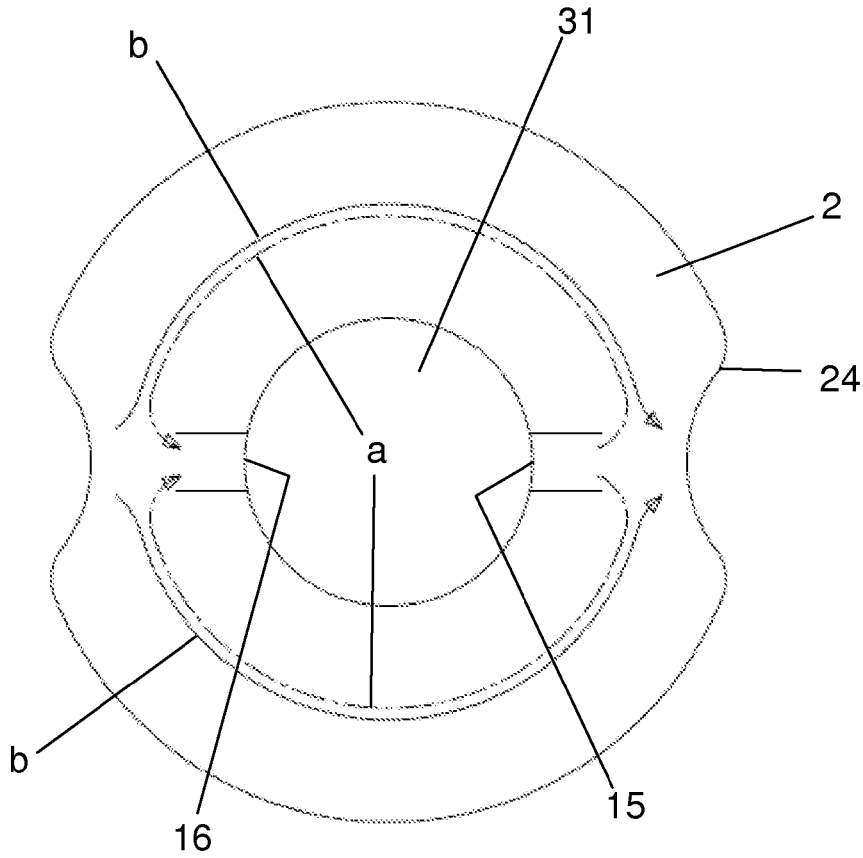
FIG. 5 discloses a heat exchanger plate of the plate heat exchanger with possible flow paths.
Figure 11:
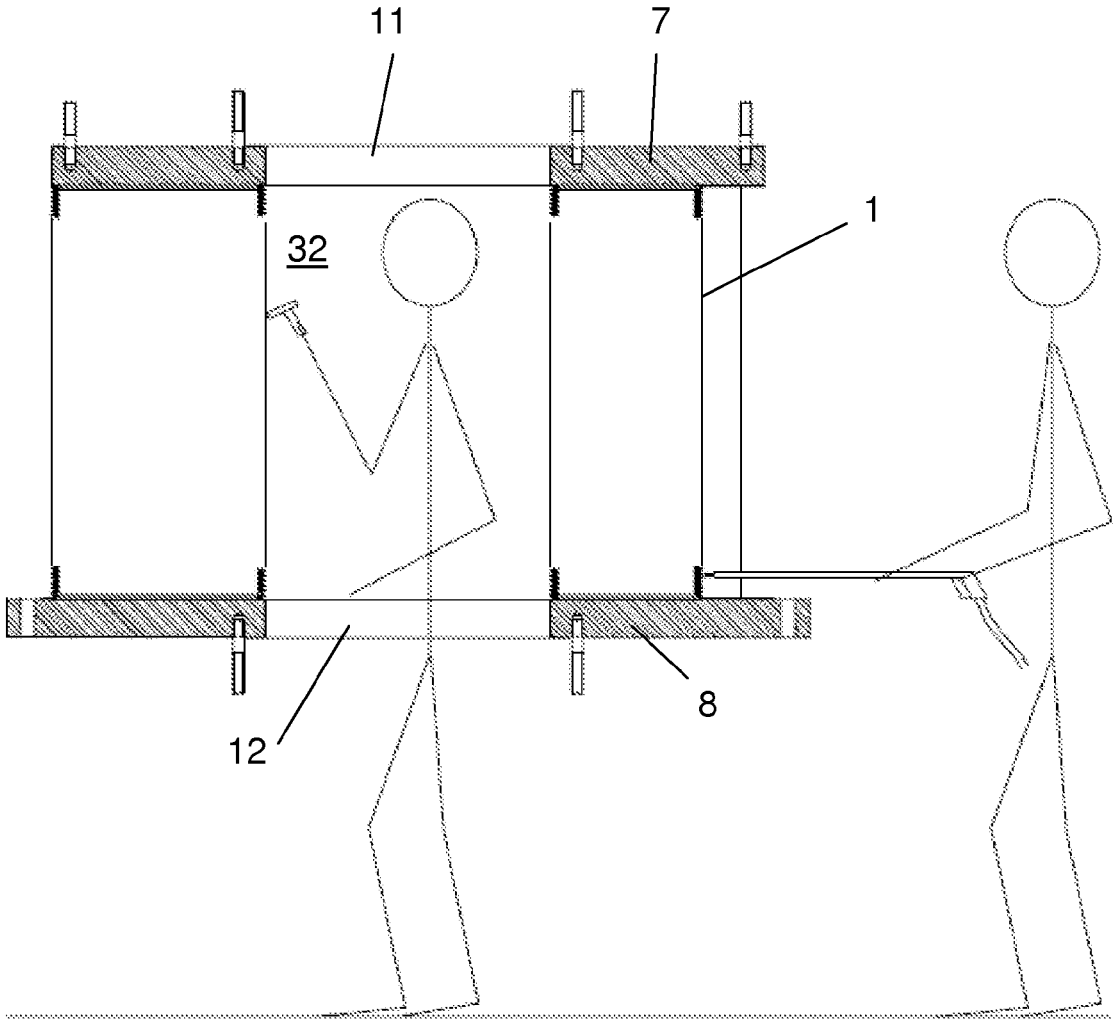
FIG. 11 discloses a longitudinal section through the plate heat exchanger according to the third embodiment in a partly dismounted state.

Each of the heat exchanger plates 2 comprises an opening 31, see FIG. 5, which forms a space 32 in the plate package 1, see FIG. 11. In the embodiments disclosed, the openings 31 and the space 32 are centrally disposed, i.e. concentric to the centre axis x. However, it is to be noted that the openings 31 and thus the space 32, the first inlet 11 and the first outlet 12 according to an alternative embodiment may be eccentric with respect to the centre axis x. The space 32 is disposed inside the first inlet 11 and the first outlet 12 and extends substantially in parallel with or is aligned with the centre axis x. The first inlet 11 has a cross sectional area perpendicular to the centre axis x, the first outlet 12 has a cross sectional area perpendicular to the centre axis x and the space 32 has a cross sectional area perpendicular to the centre axis x. The sum of the cross sectional area of the first inlet 11 and the cross sectional area of the first outlet 12 is equal or approximately equal to the cross sectional area of the space 32.

The plate heat exchanger comprises means arranged to create, for each of the first plate interspaces 3, an inlet opening 15 for the first medium from the space 32 into the first plate interspace 3, and an outlet opening 16 for the first medium from the first plate interspace 3 to the space 32. Such means may be provided in various ways. For instance, gaskets may be provided in the first plate interspace 3 in such a way that two openings are created between the space 32 and each of the first plate interspaces 3. The inlet openings 15 and the outlet openings 16, which are separated from each other, may also be achieved by means of an insert unit to be explained more closely below.

The inlet opening 15 and the outlet opening 16 are disposed in such a way that the first medium is divided into two flow paths a in the first plate interspace 3 between the inlet opening 15 and the outlet opening 16. In the embodiments discloses, see FIG. 5, the inlet opening 15 and the outlet opening 16 are located opposite to each other on a respective side of the centre axis x.

Figure 6:
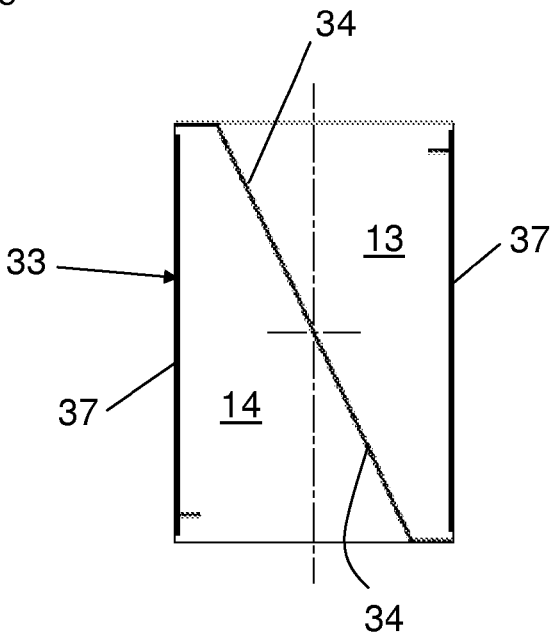
FIG. 6 discloses a longitudinal section of a separation device of the plate heat exchanger.
Figure 7:
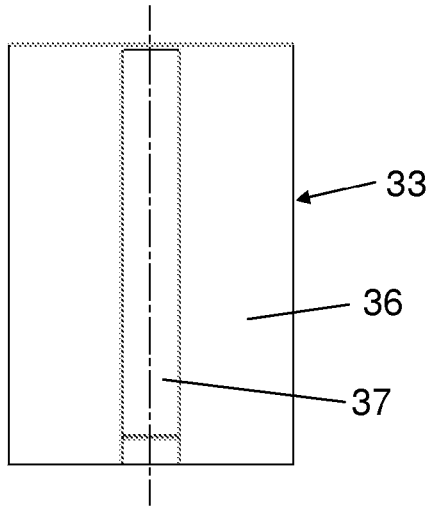
FIG. 7 discloses a side view of the separation device.

The plate heat exchanger also comprises a separation device 33, see especially FIGS. 6 and 7, which is disposed in the space 32. The separation device 33 divides the space 32 into a first part space and a second part space. The part spaces extend through the opening of all heat exchanger plates 2.

In the embodiments disclosed in FIGS. 1-9, the first part space forms a first inlet chamber 13, which extends through the first opening 31 of all heat exchanger plates 2 and permits communication between the first inlet 11 and the inlet openings 15. The second part space forms a first outlet chamber 14, which extends through the opening 31 of all heat exchanger plates 2 and permits communication between the first outlet 12 and the outlet openings 16. The separation device 33 comprises a partition sheet 34, which extends through the opening 31 of all heat exchanger plates 2 and which forms a wall between the first inlet chamber 13 and the first outlet chamber 14.

The means mentioned above comprise in the embodiments disclosed an inner envelope 36 which has a circular cylindrical, or substantially circular cylindrical, shape. The inner envelope 33 forms together with the partition sheet 34 the first inlet chamber 13 and the first outlet chamber 14. The inner envelope 36 comprises two slots 37, which are located substantially opposite to each other and form the above-mentioned inlet openings 15 and outlet openings 16, i.e. the inner envelope 36 and the two opposite slots create an inlet opening 15 to and an outlet opening 16 from each first plate interspace 3, which openings 15 and 16 are separated from each other. The inlet openings 15 permit communication between the first inlet chamber 13 and the first plate interspaces. The outlet openings 16 permit communication between the first outlet chamber 14 and the first plate interspaces 3.

The separation device 33 is in the embodiments disclosed provided in and connected to the inner envelope 36. The separation device 33 and the inner envelope 36 together form an insert unit which is displaceably provided in the space 32.

Each of the heat exchanger plates 2 has an outer edge and a circular shape along more than half of the outer edge. In the embodiments disclosed, each heat exchanger plate 2 may have a substantially circular shape. Each heat exchanger plate 2 comprises a recess 23, which is disposed immediately inside the second inlet 21, and a recess 24, which is disposed immediately inside the second outlet 22. The shape of the heat exchanger plates 2 thus deviates from the circular shape merely through these two recesses 23 and 24.

The recess 23 thus together with the casing, i.e. the outer envelope 6 and the end plate members 7, 8, forms a second inlet chamber 25. The second inlet chamber 25 communicates with the second inlet 21 and the second plate interspaces 4. The recess 24 form together with the casing, i.e. the outer envelope 6 and the end plate members 7, 8, a second outlet chamber 26. The second outlet chamber 26 communicates with the second outlet 22 and the second plate interspaces 4. It is to be noted that the second inlet 21 and/or the second outlet 22 according to an alternative embodiment may extend through one or several of two end plate members 7, 8.

In the embodiments disclosed, the outer edge of the heat exchanger plates 2 abuts with the circular shape, or substantially abuts, an inner surface of the outer envelope 6. In this case it is thus essential that the recesses 23 and 24 in order to enable the achievement of the inlet chamber 25 and the outlet chamber 26, functioning as distribution spaces. Any distribution member outside the outer envelope 6 is thus not necessary.

With the above-described arrangement of the first inlet chamber 13, the first outlet chamber 14, the second inlet chamber 25 and the second outlet chamber 26, the flow paths a and b illustrated in FIG. 5 are thus achieved for the two media. The first medium thus flows into the first plate interspaces 3 and in part flows extending along a respective substantially semi-circular flow path a. The second medium flows in via the first inlet chamber 25 in each of the second plate interspaces 4 and is divided into two part flows which each extends along a respective semi-circular flow path b. In FIG. 5, the follow paths a and b are arranged in a counter flow. The inlet and outlet chambers 13, 14, 25, 26 also permit the flow paths a, b to extend in parallel flow.

In the embodiment disclosed in FIGS. 1-4, the end plate members 7, 8 are permanently connected to the outer envelope 6, for instance by means of a weld joint. As appears from FIG. 4, the space 32, i.e. the first inlet chamber 13 and the first outlet chamber 14, is accessible via the first inlet 11 and the first outlet 12, respectively. This embodiment is especially suitable both when the first medium and the second medium are clean and do not result in clogging of the plate interspaces 3 and 4.

Figure 8:
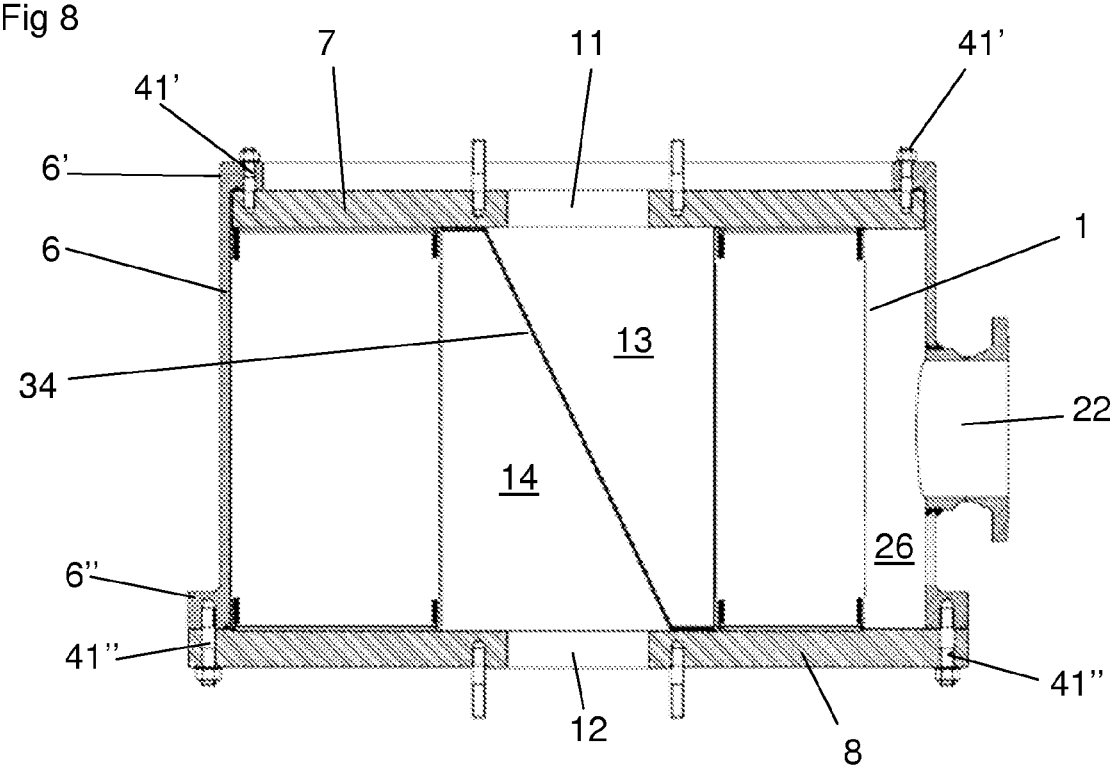
FIG. 8 discloses a longitudinal section through the plate heat exchanger according to a second embodiment.

FIG. 8 discloses a second embodiment of a plate heat exchanger in a mounted state, which differs from the first embodiment merely in that the end plate members 7 and 8 are releasably connected to the outer envelope 6. In such a way, the plate heat exchanger may be dismounted. The end plate members 7, 8 are connected to the outer envelope 6 by means of a suitable releasable connection. An example of a suitable releasable connection is screw joints.

Each end plate member 7, 8 has an inner surface facing the plate package 1, an outer surface facing away from the plate package 1 and a surrounding surface connecting the first surface and the second surface to each other. The surrounding surface of a first end plate member 7 faces an inner surface of the outer envelope 6, as appears from FIGS. 8 and 9. The inner surface and the outer surface of the first end plate member 7 thus have an area which is somewhat less than an inner cross sectional area of the outer envelope 6. In the circular cylindrical embodiments disclosed, the first end plate member 7 has a first outer diameter which is somewhat less than an inner diameter of the outer envelope 6. In such a way, the outer envelope 6 and the first end plate member 7 are displaceable in relation to each other along the centre axis x. Furthermore, the outer envelope 6 has a first envelope end, a second envelope end, a first flange 6' at the first envelope end and a second flange 6" at the second envelope end. The second end plate member 8 has a second outer diameter which is larger than the inner diameter of the outer envelope 6 and which is equally along, or at least substantially equally long, as the outer diameter of the second flange 6".

The first end plate member 7 is releaseably connected to the first flange 6' by means of a number of screw joints 41' of the releasable connections. The second end plate member 8 is releaseably connected to the second flange 6" by means of a number of second screw joints 41" of the releasable connections. The first flange 6' extends inwardly from the first envelope end and abuts the outer surface of the first end plate member 7. The second flange 6" extends outwardly from the second envelope end and abuts the inner surface of the second end plate member 8.

During this mounting, the screw joints 41', 41" are released, wherein the outer envelope 6 may be lifted from the plate package 1 and from the end plate members 7 and 8, which in this case may be welded to the plate package 1. It is to be noted that the insert unit with the inner envelope 36 and the separation device 33 is substantially identical to the insert unit of the first embodiment. This embodiment is particularly suitable both when the first medium is clean but the second medium may result in clogging of the second plate interspaces 4 since these are easily accessible for cleaning when the outer envelope 6 has been removed. If the end plate members 7, 8 according to a variant of the second embodiment are not permanently connected to the plate package 1, it is possible to pull out the insert unit, i.e. the inner envelope 36 and the separation device 33, from the space 32 when one of the end plate members 7, 8 has been removed.

Figure 9:
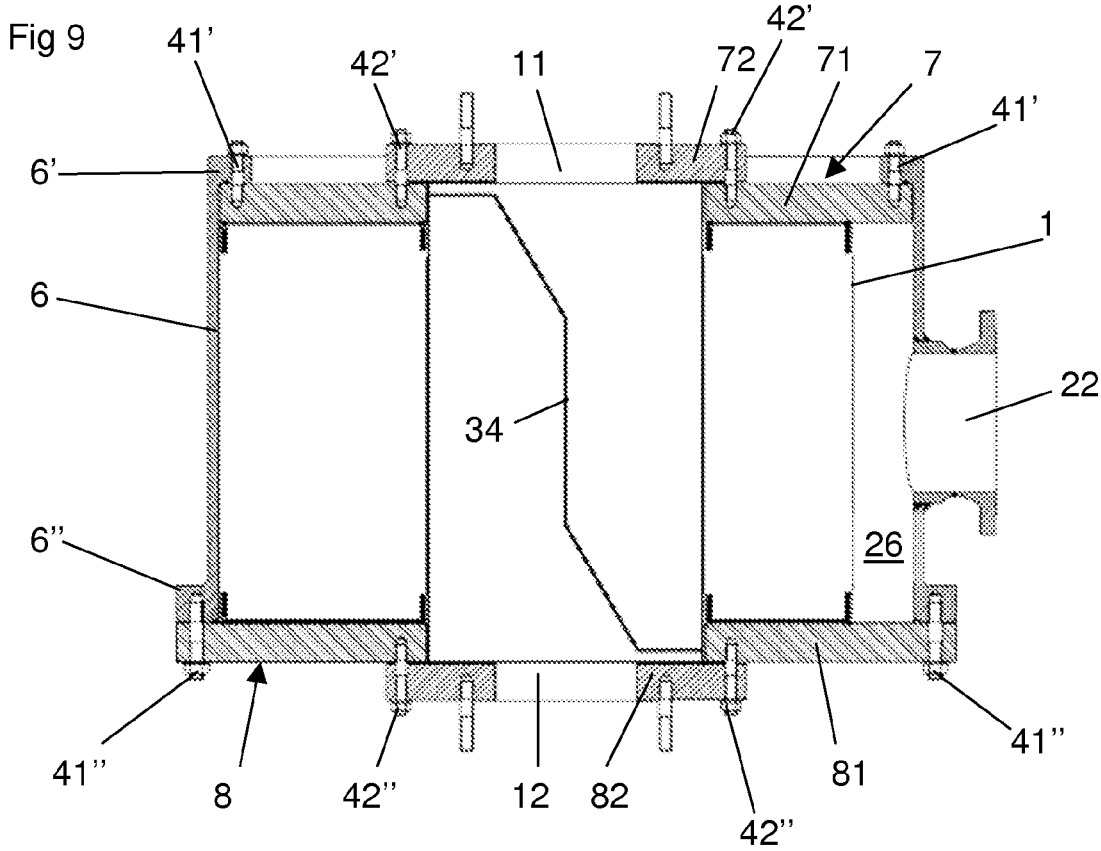
FIG. 9 discloses a longitudinal section through a plate heat exchanger according to a third embodiment.

FIG. 9 discloses a third embodiment of the plate heat exchanger in a mounted state, which differs from the two preceding embodiments in that each of the end plate members 7, 8 comprises a first plate 71, 81 and a second plate 72, 82. The first plate 71 of the first end plate member 7 has a first outer diameter and is connected to the outer envelope 6 and more precisely to the first flange 6' by means of a number of first screw joints 41. The first plate 81 of the second plate member 8 has a second outer diameter, which is larger than the first outer diameter and connected to the outer envelope 6 and more precisely to the second flange 6" by means of a number of second screw joints 41".

The second plate 72, 82 of each end plate member 7, 8 has an outer diameter which is less than the first outer diameter and the second outer diameter. The second plate 72, 82 is attached to the first plate 71, 81 by means of a releasable connection, for instance a number of screw joints 42', 42" in such a way that the second plate 72, 82 is removable from the first plate 71, 81. By removing one or both of the second plates 72, 82 from the respective first plate 71, 81, the space 32 becomes completely accessible in such a way that the insert unit, i.e. the inner envelope 36 and the separation device 33, may be removed from the space 32. FIG. 11 discloses a plate heat exchanger according to a third embodiment in a dismounted state. In the disclosed dismounted state, the two second plates 72, 82 have been removed and a person may reach the first plate interspaces 3 via the space 32. Furthermore, the outer envelope 6 has been removed from the first plates 71, 81 so that a person also may reach the second plate interspaces 4.

The third embodiment disclosed in FIG. 9 also points to the possibility of modifying the insert unit. The partition sheet 34 here has another extension with a central, substantially vertical portion, which is parallel to the centre axis x, and two angled portions. Such a design of the partition sheet 34 is advantageous especially when the space 32 and the separation device 33 have a relatively long extension along the centre axis x.

Figure 10:
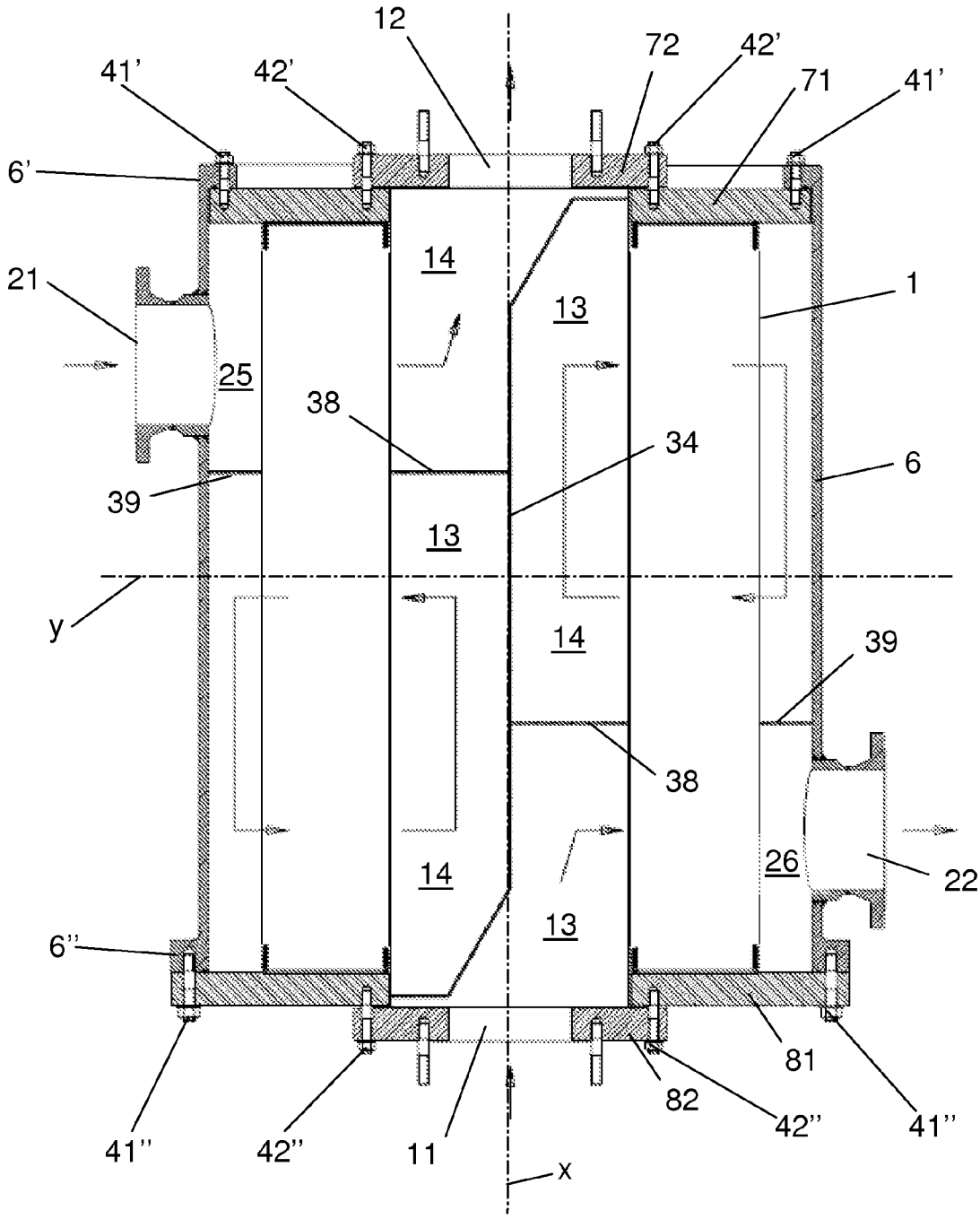
FIG. 10 discloses a longitudinal section through a plate heat exchanger according to a fourth embodiment.

FIG. 10 discloses a fourth embodiment of a plate heat exchanger in a mounted state, which differs from the remaining embodiments in that the plate package 1 has been divided into different sections. As illustrated in FIG. 10, the first part space is divided into two sections, wherein one of the sections forms an inlet chamber 13 for the first medium and the other of the sections forms an outlet chamber 14 and an inlet chamber 13 for the first medium. The second part space is also divided into two sections, wherein one of the sections forms an outlet chamber 14 and an inlet chamber 13 for the first medium and the other of the sections forms an inlet chamber 13 for the first medium. According to a further embodiment (not disclosed in the figures), the first part space may be divided into an inlet chamber and an outlet chamber for the first medium, wherein the second part space may form either an inlet chamber or an outlet chamber for the first medium.

The separation device 33 here has a partition sheet 34 which also comprises two baffles 38 which are parallel to the diametric axis y. Furthermore, there are baffles 39 dividing the inlet chamber 25 and the outlet chamber 26. With structure disclosed the media are conveyed through the plate interspaces 3 and 4, respectively, more than once, in the example disclosed three times. Of course, the plate heat exchanger may be designed in such a way that the media are conveyed through the plate interspaces 3 and 4, respectively, any number of times. In FIG. 10, the media flow in counter flow but the plate heat exchanger may also be provided in such a way that they also may flow in parallel flow with each other. Furthermore, from. FIG. 10 it can be seen that the second inlet 21 and the second outlet 22 are displaced along the centre axis x. However, the second inlet 21 and the second outlet 22 extend in parallel to each other and to the diametric axis y.

According to a further embodiment of the invention, not disclosed in the figures, the above-mentioned part spaces may be formed by two separate openings of each heat exchanger plate. Also in this embodiment, the first part space forms a first inlet chamber, which extends through one of the openings of all heat exchanger plates and permits communication between the first inlet and the first plate interspaces via inlet openings. The second part space forms a first outlet chamber, which extends through one of the openings of all heat exchanger plates and permits communication between the first outlet and the first plate interspaces via outlet openings.

The invention is not limited to the embodiments disclosed but may be varied and modified within the scope of the following claims.

The invention claimed is:

1. A plate heat exchanger comprising a plate package having a plurality of heat exchanger plates, which are stacked onto each other and arranged in such a way that they in the plate package form first plate interspaces for a first medium and second plate interspaces for a second medium, a casing, which encloses the plate package and which comprises a circular cylindrical outer envelope and two end plate members, the outer envelope defining a center axis which extends through the two end plate members, a first inlet and a first outlet, which are adapted to convey the first medium into and out from the plate heat exchanger and extend through a respective one of the two end plate members, and a second inlet and a second outlet, which are adapted to convey the second medium into and out from the plate heat exchanger, each of the heat exchanger plates comprising an opening which forms a space in the plate package, wherein the space communicates with the first inlet and the first outlet, and the plate heat exchanger comprises, for each of the first plate interspaces, an inlet opening for the first medium from the space into the first plate interspace and an outlet opening for the first medium from the first plate interspace to the space, wherein the plate heat exchanger comprises a separation device disposed in the space and arranged to divide the space into a first part space and a second part space, which part spaces extend through the opening of all heat exchanger plates, and wherein the first part space forms a first inlet chamber, which extends through the opening of two or more heat exchanger plates and permits communication between the first inlet and the inlet openings, and the second part space forms a first outlet chamber, which extends through the opening of two or more heat exchanger plates and permits communication between the first outlet and the outlet openings.

2. A plate heat exchanger according to claim 1, wherein the inlet opening and the outlet opening are disposed in such a way that the first medium is divided into two flow paths in the first plate interspace between the inlet opening and the outlet opening.

3. A plate heat exchanger according to claim 1, wherein the inlet opening and the outlet opening are located opposite to each other on a respective side of the center axis.

4. A plate heat exchanger according to claim 1, wherein the first inlet has a cross sectional area perpendicular to the center axis, the first outlet has a cross sectional area perpendicular to the center axis and the space has a cross sectional area perpendicular to the center axis, wherein the sum of the cross sectional area of the first inlet and the cross sectional area of the first outlet is equal to or approximately equal to the cross sectional area of the space.

5. A plate heat exchanger according to claim 1, wherein at least one of the first part space and the second part space is divided into at least two sections, wherein one of the sections forms an inlet chamber for the first medium and the other of the sections forms an outlet chamber for the first medium.

6. A plate heat exchanger according to claim 1, wherein the separation device comprises a partition sheet which extends through the opening of all heat exchanger plates and which forms a wall between the first part space and the second part space.

7. A plate heat exchanger according to claim 1, wherein the means comprises an inner envelope which is provided in the space and forms a wall between the space and the first plate interspaces, and wherein the inner envelope comprises two slots forming the inlet openings and outlet openings.

8. A plate heat exchanger according to claim 7, wherein the separation device is provided in and connected to the inner envelope.

9. A plate heat exchanger according to claim 1, wherein the space is concentric with respect to the center axis.

10. A plate heat exchanger according to claim 7, wherein the slots are located opposite to each other on a respective side of the center axis.

11. A plate heat exchanger according to claim 1, wherein each of the heat exchanger plates has an outer edge and a circular shape along more than half of the outer edge.

12. A plate heat exchanger according to claim 1, wherein each heat exchanger plate has a recess, disposed immediately inside the second inlet, and a recess, disposed immediately inside the second outlet, wherein the recess inside the second inlet creates space for a second inlet chamber, which communicates with the second inlet and the second plate interspaces, and wherein the recess inside the second outlet creates space for a second outlet chamber, which communicates with the second outlet and the second plate interspaces.

13. A plate heat exchanger according to claim 1, wherein the second inlet and the second outlet extend through the outer envelope.

14. A plate heat exchanger according to claim 13, wherein the second inlet and the second outlet are concentric to each other.

15. A plate heat exchanger according to claim 14, wherein the second inlet and the second outlet extend along a diametric axis which intersects the center axis.

16. A plate heat exchanger according to claim 1, wherein the first inlet and first outlet are concentric to each other and to the outer envelope.

17. A plate heat exchanger according to claim 1, wherein at least one of the end plate members is attached to the outer envelope by a releasable connection.

18. A plate heat exchanger according to claim 1, wherein the separation device is displaceable along the center axis in the space in such a way that the separation device may be pulled out of the space when the at least one end plate member is removed.

19. A plate heat exchanger according to claim 7, wherein the inner envelope is displaceable along the center axis in the space in such a way that the inner envelope may be pulled out of the space when the at least one end plate member is removed.

20. A plate heat exchanger according to claim 1, wherein at least one of the end plate members comprises a first plate, which has a first diameter and which is connected to the outer envelope, and a second plate, which has a second diameter that is less than the first diameter and which is attached to the first plate by a releasable connection in such a way that the second plate is removable from the first plate.

21. A plate heat exchanger according to claim 20, wherein the second plate is provided on the first plate outside the space.

22. A plate heat exchanger according to claim 21, wherein the separation device is displaceable along the center axis in the space in such a way that the separation device can be pulled out from the space when the second plate is removed.

23. A plate heat exchanger according to claim 21, wherein the inner envelope is displaceable along the center axis in the space in such a way that the inner envelope can be pulled out from the space when the second plate is removed.

24. A plate heat exchanger according to claim 1, wherein the heat exchanger plates in the plate package are welded to each other in pairs.

25. A plate heat exchanger according to claim 1, wherein all heat exchanger plates in the plate package are welded to each other.

26. A plate heat exchanger according to claim 1, wherein at least one of the end plate members is welded to the plate package.

27. A plate heat exchanger according to claim 1, wherein the end plate members each have an inner surface facing the plate package, an outer surface facing away from the plate package and a surrounding surface connecting the inner surface and the outer surface to each other.

28. A plate heat exchanger according to claim 27, wherein the surrounding surface of one of the end plate members faces an inner surface of the outer envelope.

29. A plate heat exchanger according to claim 27, wherein the outer envelope has a first envelope end, a second envelope end, a first flange at the first envelope end and a second flange at the second envelope end, wherein the end plate members are connected to a respective one of the first flange and the second flange.

30. A plate heat exchanger according to claim 28, wherein the first flange extends inwardly from the first envelope end and abuts the outer surface of the first end plate member.

31. A plate heat exchanger according to claim 29, wherein the second flange extends outwardly from the second envelope end and abuts the inner surface of a second end plate member of the end plate members.

* * * * *